US006502389B2

(12) United States Patent
Katayama et al.

(10) Patent No.: US 6,502,389 B2
(45) Date of Patent: Jan. 7, 2003

(54) AIR-FUEL RATIO CONTROL SYSTEM FOR INTERNAL COMBUSTION ENGINE AND CONTROL METHOD THEROF

(75) Inventors: Akihiro Katayama, Toyota (JP); Toshinari Nagai, Sunto-gun (JP); Akira Kamoto, Susono (JP); Naoto Kato, Susono (JP); Shinji Kojima, Aichi-gun (JP); Naoki Baba, Aichi-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/025,452

(22) Filed: Dec. 26, 2001

(65) Prior Publication Data

US 2002/0078683 A1 Jun. 27, 2002

(30) Foreign Application Priority Data

Dec. 26, 2000 (JP) ..... 2000-395477

(51) Int. Cl.[7] ..... F01N 3/00

(52) U.S. Cl. ..... 60/285; 60/274; 60/276; 701/109

(58) Field of Search ..... 60/274, 276, 277, 60/285; 701/103, 109

(56) References Cited

U.S. PATENT DOCUMENTS

| | | | | |
|---|---|---|---|---|
| 5,325,664 A | * | 7/1994 | Seki et al. | 60/276 |
| 5,626,014 A | * | 5/1997 | Hepburn et al. | 60/274 |
| 5,732,552 A | * | 3/1998 | Matsumato et al. | 60/276 |
| 5,966,930 A | * | 10/1999 | Hatano et al. | 60/276 |
| 6,003,308 A | * | 12/1999 | Tsutsumi et al. | 60/276 |
| 6,082,101 A | * | 7/2000 | Manaka et al. | 60/285 |

FOREIGN PATENT DOCUMENTS

| | | |
|---|---|---|
| JP | 5-195842 A | 8/1993 |
| JP | 9-72235 A | 3/1997 |

* cited by examiner

*Primary Examiner*—Thomas Denion
*Assistant Examiner*—Binh Tran
(74) *Attorney, Agent, or Firm*—Oliff & Berridge, PLC

(57) ABSTRACT

An air-fuel ratio control system for an internal combustion engine estimates an oxygen storage amount of a catalyst based on a record of an oxygen storage amount, and controls an air-fuel ratio based on the estimated oxygen storage amount. The catalyst is divided into multiple sections in a flow direction of an exhaust gas, the oxygen storage amount in a specified section is estimated according to a behavior of an exhaust gas on upstream and downstream sides of the respective specified sections, and the air-fuel ratio is controlled based on the estimated oxygen storage amount in the specified section.

25 Claims, 15 Drawing Sheets

AIR-FUEL RATIO CONTROL SYSTEM FOR INTERNAL COMBUSTION ENGINE AND CONTROL METHOD THEROF

INCORPORATION BY REFERENCE

The disclosure of Japanese Patent Application No. 2000-395477 filed on Dec. 2, 2000 including the specification, drawings and abstract is incorporated herein by reference in its entirety.

BACKGROUND OF THE INVENTION

1. Field of Invention

The invention relates to an air-fuel ratio control system for an internal combustion engine and a control method thereof.

2. Description of Related Art

In internal combustion engines, an exhaust emission purification catalyst (three-way catalyst) for purifying an exhaust gas and an air-fuel ratio sensor for detecting an air-fuel ratio are arranged in an exhaust passage. A feedback control is performed on the basis of the air-fuel ratio detected by the air-fuel ratio sensor such that the air-fuel ratio of an air-fuel mixture becomes a stoichiometric air-fuel ratio, thereby reducing emissions of nitrogen oxides (NOx), carbon monoxides (CO), and hydrocarbons (HC) at the same time.

Performing the above-mentioned feedback control with a sufficient accuracy effectively improves a purification rate of the exhaust gas emitted by the internal combustion engines. Also, controlling an oxygen adsorption function of the exhaust emission purification catalyst effectively improves the purification rate of NOx, CO, and HC.

Investigations have been conducted on a control for effectively utilizing an oxygen adsorption function. For example, Japanese Patent Application laid-open No. 5-195842 discloses a type of control system which controls the oxygen adsorption function. The control system estimates an amount of oxygen that can be adsorbed in a whole part of the exhaust emission purification catalyst (oxygen storage amount), and controls the air-fuel ratio such that the oxygen storage of an amount of oxygen becomes a certain targeted value.

The above-mentioned control system performs the air-fuel ratio control based on the oxygen storage amount estimated on the assumption that the status of the entire exhaust emission purification catalyst is uniform. However, the oxygen adsorption status in the exhaust emission purification catalyst is not uniform. Hence, in a case where the air-fuel ratio control is performed on the assumption that the oxygen absorption status in the exhaust emission purification catalysis is uniform, there is a possibility that an estimation accuracy will temporarily decrease, and that the air-fuel ratio control will become inaccurate. This creates a drawback such that an excess amount of oxygen storage needs to be secured, and that the oxygen adsorption capacity cannot be efficiently used.

SUMMARY OF THE INVENTION

It is an aspect of the invention to improve a purification efficiency of an exhaust gas by effectively utilizing an oxygen adsorption capacity of a catalyst.

According to a first aspect of the invention, an air-fuel ratio control system for an internal combustion engine includes a controller having a calculator which estimates an oxygen storage amount of a catalyst provided in an exhaust passage of an internal combustion engine. The controller controls an air-fuel ratio based on the estimated oxygen amount. The calculator divides the catalyst into multiple sections in a flow direction of an exhaust gas, and calculates a change in the oxygen storage amount in a specified section among the multiple sections based on an air-fuel ratio of the exhaust gas flowing into the catalyst. The controller estimates the oxygen storage amount in the specified section based on a record of the change in the oxygen storage amount. The controller controls the air-fuel ratio based on the oxygen storage amount in the specified section estimated by the calculator.

Further, another aspect of the invention is to provide an air-fuel ratio control method for an internal combustion engine including the steps of dividing the catalyst into multiple sections in a flow direction of an exhaust gas, calculating a change in the oxygen storage amount in a specified section among the multiple sections based on an air-fuel ratio of the exhaust gas flowing into the catalyst, estimating the oxygen storage amount in the specified section based on a record of the change in the oxygen storage amount, and controlling the air-fuel ratio based on the estimated oxygen storage amount in the specified section.

DETAILED DESCRIPTION OF EXEMPLARY EMBODIMENTS

Prior to a description of the exemplary embodiments, an oxygen adsorption function of an exhaust emission purification catalyst will be described.

Figure 1:
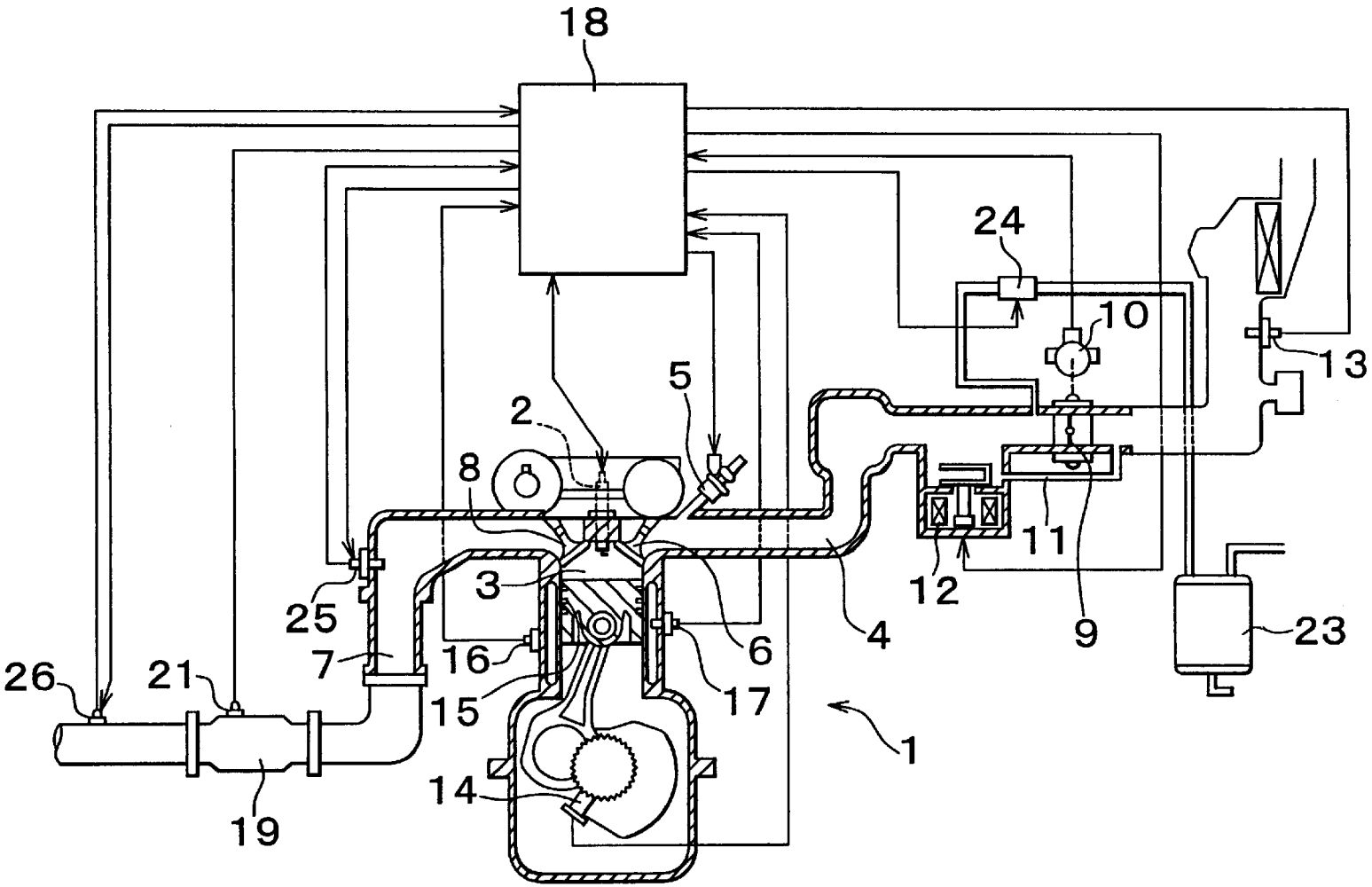
FIG. 1 is a section view of an internal combustion engine including a control system according to an embodiment of the invention.

FIG. 1 illustrates an exhaust emission purification catalyst 19 provided in an exhaust passage 7. Multiple exhaust emission purification catalysts can be provided in at least one exhaust passage. The exhaustive emission purification catalyst can be provided in series or in parallel at branching points. For example, in a four-cylinder engine, one exhaust emission purification catalyst can be provided at a point where a pair of exhaust passages extending from a pair of cylinders converge while another catalyst can be provided at a point where another pair of exhaust passages converge. However, in the exemplary embodiment of FIG. 1, one exhaust emission purification catalyst 19 is provided in the exhaust passage 7 downstream of a point where exhaust passages extending from the respective cylinders 3 converge.

In the embodiment described below, a three-way catalyst that adsorbs as the exhaust emission purification catalyst 19. The three-way catalyst includes constituents, such as for example, ceria ($CeO2$) that is provided to adsorb and detach oxygen contained in the exhaust gas.

An oxygen adsorption/detachment operation (change in an oxygen storage amount of this three-way catalyst is to adsorb excess oxygen in the exhaust gas when the air-fuel ratio of the air-fuel mixture is in a lean region, and to detach the adsorbed oxygen when the air-fuel ratio is in a rich region. The three-way-catalyst purifies the exhaust gas containing, e.g., NOx, CO, and HC and deoxidizing NOx by absorbing excess oxygen when the air-fuel mixture is lean, and oxidizing CO and HC by detaching the adsorbed oxygen when it is rich.

The term "oxygen storage amount" is defined as an amount of oxygen which is adsorbed and retained (before detachment) by an exhaust emission purification catalyst. The term "oxygen storage amount" is intended to cover oxygen stored within the catalyst and/or oxygen attached onto the catalyst. According to this invention, oxygen is adsorbed in the catalyst and removed from the catalyst repeatedly and the oxygen stored or retained at a predetermined time in the catalyst is estimated based on a record of the oxygen adsorption/removal amount.

However, if the three-way catalyst has already adsorbed the oxygen to the limit of an oxygen adsorption capacity thereof, purification of the exhaust by oxidizing NOx contained therein becomes insufficient because oxygen is not adsorbed when an exhaust air-fuel ratio of an incoming exhaust gas is lean. On the other hand, if the exhaust emission purification catalyst has already detached all oxygen, and therefore adsorbs no oxygen, the purification of the exhaust gas by deoxidizing CO and HC contained therein becomes insufficient because no oxygen is detached when the exhaust air-fuel ratio of the incoming exhaust is rich. For this reason, the invention provides control of the oxygen storage amount which is effective whether the exhaust air-fuel ratio of the incoming exhaust gas is lean or rich.

Because the three-way catalyst adsorbs or detaches oxygen depending on the exhaust air-fuel ratio, as mentioned above, the oxygen storage amount can be controlled by controlling the air-fuel ratio. In conventional air-fuel ratio controls, a basic fuel injection quantity is calculated on the basis of an intake air volume, etc., and a final fuel injection quantity is determined by multiplying the basic fuel injection quantity by various correction coefficients (or adding various correction coefficients to the basic fuel injection quantity). In conventional controls, a correction coefficient for controlling the oxygen storage amount is determined according to the oxygen storage amount and the air-fuel ratio control based on the oxygen storage amount performed using the coefficient.

The air-fuel ratio control independent of the oxygen storage amount may be performed. In such a case, the above-mentioned correction coefficient based on the oxygen storage amount is not calculated, or is not reflected on an actual air-fuel ratio control even when it is calculated.

According to this embodiment, an air-fuel ratio control for an internal combustion engine according to an embodiment of the invention will be described. FIG. 1 shows a configuration of an internal combustion engine including a control system according to the embodiment.

The control system according to the embodiment controls an engine 1, e.g., an internal combustion engine. As shown in FIG. 1, the engine 1 generates a driving force by igniting air-fuel mixtures in the respective cylinders 3 by an ignition plug 2. Air inhaled from outside moves through an air intake passage 4 and is mixed with fuel injected by an injector 5 to create an air-fuel mixture. The air-fuel mixture is then inhaled into the cylinder 3. An air intake valve 6 is provided between the cylinder 3 and the air intake passage 4 so as to open and close the communication therebetween. The air-fuel mixture burned in the cylinder 3 is discharged into an exhaust passage 7 as an exhaust gas. An exhaust valve 8 is provided between the cylinder 3 and the exhaust passage 7 so as to open and close the communication therebetween.

A throttle valve 9 which controls an air intake volume of the air to be sucked into the cylinder 3 is arranged in the air intake passage 4. A throttle position sensor 10 detects a throttle position and is connected with the throttle valve 9. Further, an air bypass valve 12 is arranged in the air intake passage 4. The air bypass valve 12 controls the air intake volume to be supplied to the cylinder 3 via a bypass passage 11 during an idling operation (when the throttle valve 9 is at a fully closed position). In addition, an air flow meter 13 which detects the air intake amount is provided in the air intake passage 4.

A crank position sensor 14 detects a position of a crank shaft and is arranged in the vicinity of a crank shaft of the engine 1. A position of a piston 15 in the cylinder 3 and an engine rotation NE can be determined based on an output of the crank position sensor 14. The engine 1 also includes a knocking sensor 16 which detects an occurrence of knocking of the engine 1. The engine 1 further includes a water temperature sensor 17 to detect a coolant temperature.

The ignition plug 2, injector 5, throttle position sensor 10, air bypass valve 12, air flow meter 13, crank position sensor 14, knocking sensor 16, water temperature sensor 17 and other sensors are connected to an electrical control unit (ECU) 18 that performs an overall control of an operation of the engine 1. The components listed above are controlled in response to signals from the ECU 18. The components can also transmit detection results to the ECU 18. A catalyst temperature sensor 21 determines a temperature of the exhaust emission purification catalyst 19 and is arranged in the exhaust passage 7. A purge control valve 24 transfers evaporated fuel in a fuel tank collected by a charcoal canister 23 to the air intake passage 4 for purging is connected to the ECU 18.

Further, an upstream air-fuel ratio sensor 25 provided upstream of the exhaust emission purification catalyst 19 and a downstream air-fuel ratio sensor 26 provided downstream thereof are connected to the ECU 18. The upstream air-fuel ratio sensor 25 is a linear air-fuel ratio sensor which linearly detects the exhaust air-fuel ratio according to the concentration of oxygen in the exhaust gas at the position where the sensor is arranged. The downstream air-fuel sensor 26 is an oxygen sensor which performs an on-off detection of the exhaust air-fuel ratio according to the concentration of oxygen in the exhaust gas at the position where the sensor is arranged. These air-fuel ratio sensors 25 and 26 can not perform detection accurately unless their temperature is increased up to a specified temperature (activation temperature), and therefore are heated by electric power supplied via the ECU 18 such that the activation temperature is reached in a short period of time.

In the ECU 18, there is provided a CPU for calculations, a RAM which stores various information such as calculation results, a backup RAM which, being supplied with power from a battery, maintains the stored information, and a ROM which stores the respective control programs, and the like. The ECU 18 controls the operation of the engine 1 based on the air-fuel ratio, and calculates the oxygen storage amount of the exhaust emission purification catalyst 19. Further, the ECU 18 performs a calculation of the fuel injection quantity injected by the injector 19, and determines deterioration degree of the exhaust emission purification catalyst 19 on the basis of a record of the oxygen storage amount. In short, the ECU 18 controls the operation of the engine 1 based on detected air-fuel ratio, calculated oxygen storage amount, and the like.

According to this embodiment, an air-fuel ratio feedback control based on an oxygen storage amount estimated by the above-mentioned air-fuel ratio control system according to the record of an oxygen adsorption/detachment amount will be described. Particularly, the exhaust emission purification catalyst 19 is divided into multiple sections in the direction of the exhaust gas flow, and the oxygen storage amount in a specified section (or all sections) is estimated on the basis of the behavior of the exhaust gases upstream and downstream of the respective sections. Accordingly, since the exhaust emission purification catalyst 19 is divided into multiple sections, an oxygen storage amount $O_2$ can accurately be determined. As a result, an appropriate air-fuel ratio control can be performed, thereby improving an efficiency of the exhaust gas purification.

Figure 2:
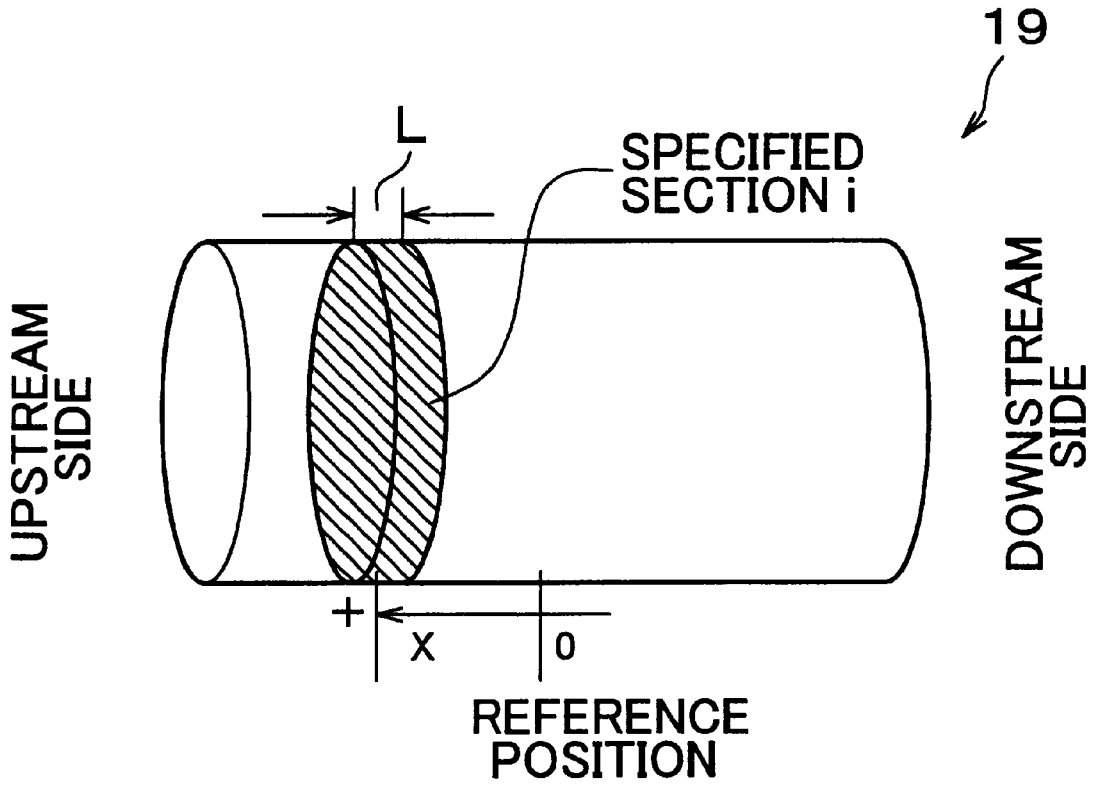
FIG. 2 is a perspective view schematically illustrating an exhaust emission purification catalyst of the control system according to the embodiment of the invention.

FIG. 2 illustrates a method for calculating an oxygen storage amount $O_{2i}$ which is an oxygen amount adsorbed in a specified section i included in n number of divided sections of the exhaust emission purification catalyst 19. FIG. 2 schematically illustrates a catalytic converter arranged in an exhaust emission purification catalyst 19.

In this embodiment, the oxygen storage amount $O_{2i}$ in the specified section i is estimated according to an exhaust air-fuel ratio A/F which is an exhaust air-fuel ratio of an exhaust gas flowing into the exhaust emission purification catalyst 19, an air intake volume Ga, and a temperature (catalyst bed temperature) Temp of the exhaust emission purification catalyst 19. Although the exhaust air-fuel ratio A/F is detected by the upstream air-fuel sensor 25 in this embodiment, the exhaust air-fuel ratio may be estimated according to behavioral models of air and fuel. The air intake volume Ga is detected by the air-flow meter 13. Further, the catalyst bed temperature Temp is estimated according to the air intake volume Ga, vehicle speed, and reaction heat of the exhaust emission purification catalyst. The catalyst bed temperature Temp in the respective sections (catalyst bed temperature Tempi for the specified section i) may be determined by, e.g., temperature sensors directly provided in the respective sections of the exhaust emission purification catalyst 19, or may be determined based on an output from one temperature sensor 21 provided in the exhaust emission purification catalyst 19.

The symbol in $O_2$in(i) represents an oxygen amount in the exhaust gas which flows into the specified section i, and $O_2$out(i) represents an oxygen amount in the exhaust gas which flows out from the specified section i toward a downstream side. Besides, $O_2$ADi which represents an amount of variation in the oxygen storage amount $O_{2i}$ in the specified section i (hereinafter referred to as oxygen adsorption/detachment amount) is determined as a function of an air intake volume $O_2$in(i), a gas diffusion rate on a surface of the catalyst, an oxygen adsorption/detachment reaction rate, a deviation, etc. The deviation is determined as a function of a maximum adsorbable oxygen amount OSCi in the specified section i, and a present oxygen storage amount $O_{2i}$ in the specified section i, etc. The gas diffusion temperature is determined as a function of a catalyst bed temperature Tempi as mentioned above.

Using the oxygen adsorption/detachment amount $O_2$ADi determined in the specified section i, the following equation is established.

$$O_2\text{out}(i)=O_2\text{in}(i)-O_2\text{ADi}$$

Also, is it possible to estimate the oxygen storage amount $O_{2i}$ in the specified section i by integrating the oxygen adsorption/detachment amount $O_2$ADi. Further, the oxygen amount $O_2$out(i) in the exhaust gas flowing out from the specified section i is equal to an oxygen amount $O_2$in(i+1) in the exhaust gas flowing into the next section located on the downstream side of the specified section i.

$$O_2\text{out}(i)=O_2\text{in}(i+1)$$

Since an oxygen amount in the exhaust gas flowing into an uppermost upstream section, (i=1) can be calculated based on the exhaust air-fuel ratio of the exhaust gas flowing into the exhaust emission purification catalyst 19 A/F, it is possible to calculate the oxygen amount in the exhaust gas flowing into the sections located on the downstream side of the respective sections by sequentially calculating the oxygen amount in the exhaust gas flowing out from the respective sections.

The oxygen storage amount $O_{2i}$ in the specified section i may be estimated for all the sections or only for the specified section i. Additionally, an entire oxygen storage amount $O_2$ or an entire oxygen adsorption/detachment amount $O_2$AD of the exhaust emission purification catalyst 19 can be determined by summing the oxygen storage amounts or oxygen adsorption/detachment amounts in all sections. According to this, a positive value of the oxygen adsorption/detachment amount $O_2$AD indicates a state where the oxygen is being adsorbed into the exhaust emission purification catalyst 19 and thus the oxygen storage amount $O_2$ is being increased. On the other hand, a negative value indicates a state where the oxygen is being detached from the exhaust emission purification catalyst 19 and thus the oxygen storage amount $O_2$ is being decreased.

A value of the oxygen storage amount $O_2$ (or the oxygen storage amount $O_{2i}$ in the respective specified sections)

ranges from 0 to the maximum adsorbable oxygen amount OSC (or OSCi). When the oxygen storage amount $O_2$ is 0, the exhaust emission purification catalyst 19 is adsorbing no oxygen. On the other hand, when the oxygen storage amount $O_2$ is equal to the maximum absorbable oxygen amount OSC, the exhaust emission purification catalyst 19 has already adsorbed oxygen to the limit. The maximum adsorbable oxygen amount OSC is not constant and may vary depending on a condition of the exhaust emission purification catalyst 19 (temperature, deterioration, etc.). Therefore the maximum adsorbable oxygen amount OSC is updated based on a detection result of the downstream air-fuel sensor 26.

In this embodiment, the oxygen storage amount $O_2$ ($O_{2i}$) is calculated based on a basic oxygen storage amount $O_2$ at a specified point in time as a reference (e.g. at the time when an ignition is turned on). The value of the basic oxygen storage amount $O_2$ is set to 0, and the value of the oxygen storage amount $O_2$ varies within a range covering both negative and positive sides with respect thereto. In such a case, an upper limit value and a lower limit value for the oxygen storage amount $O_2$ may be determined according to a condition of the exhaust emission purification catalyst 19 at a certain point of time may be determined, and a difference between those values can be taken as an equivalent to the aforementioned maximum adsorbable oxygen amount OSC.

According to this embodiment, the upstream air-fuel sensor 25, ECU 18, and the like can estimate the oxygen storage amount $O_2$ ($O_{2i}$) based on the record of the oxygen adsorption/detachment amount $O_2AD$ ($O_2ADi$), and the ECU 18, air flow meter 13, injector 5, and the like control the air-fuel ratio.

Figure 3:
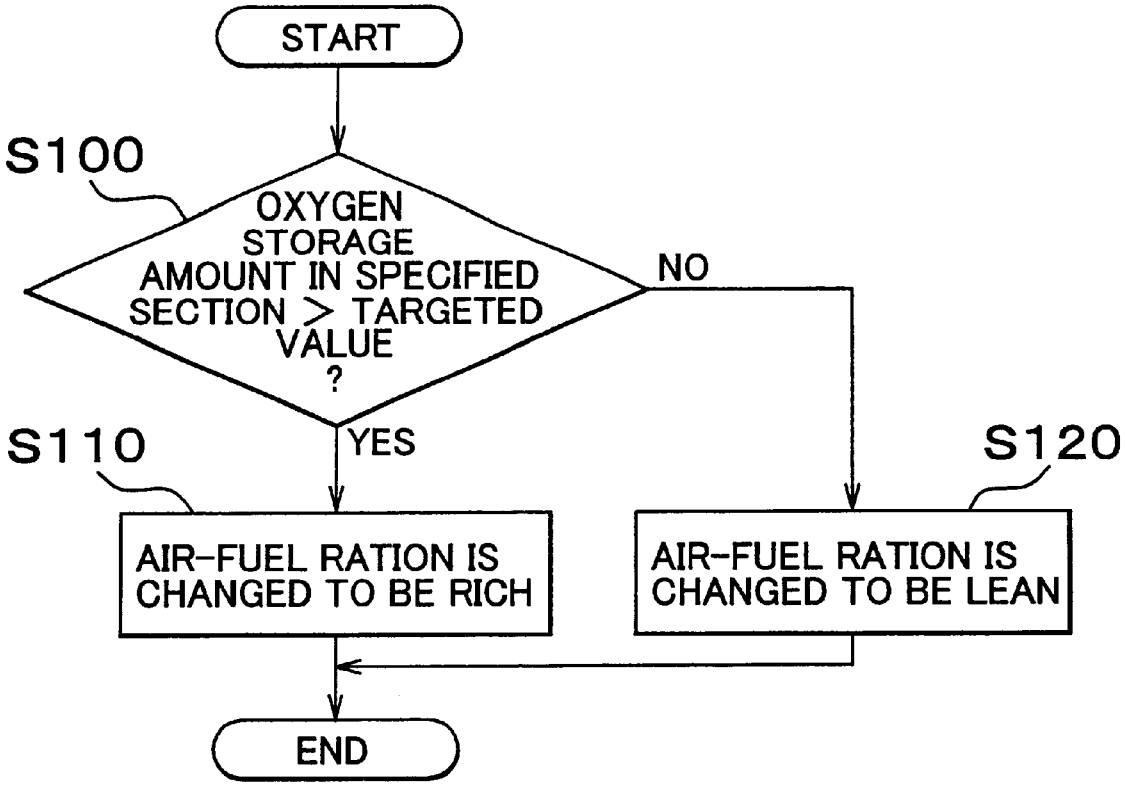
FIG. 3 is a flowchart of an air-fuel ratio control in the control system according to the embodiment of the invention.

FIG. 3 is a flowchart of the control in this embodiment. The air-fuel ratio is controlled based on the oxygen storage amount in the specified section i determined in the following manner. First, it is determined whether or not an estimated oxygen storage amount $O_{2i}$ is larger than a targeted valued in step S100.

When the oxygen storage amount $O_{2i}$ is determined to be larger than the targeted value in step S100, the air-fuel ratio is controlled to be rich in steps S110 to reduce the oxygen storage amount $O_{2i}$ in the specified section i of the exhaust emission purification catalyst 19. As a result of controlling the air-fuel ratio to be rich, the exhaust air-fuel ratio of the exhaust gas flowing into the specified section i also becomes rich, and the oxygen adsorbed in the specified section i is detached, thereby promoting the purification of the rich exhaust gas.

Alternatively, when the oxygen storage amount $O_{2i}$ is determined to be equal to or smaller than the targeted value in step S100, the air-fuel ratio is controlled to be lean in step S120 to increase the oxygen storage amount $O_{2i}$ in the specified section i. As a result of controlling the air-fuel ratio to be lean, the exhaust air-fuel ratio of the gas flowing into the specified section i also becomes lean, and excess oxygen in the exhaust gas is adsorbed in the specified section i.

In accordance with the embodiment, a control for selecting a section to be used as a reference for the air-fuel control from multiple divided sections will be described. In a case where the specified section i to be used as a reference for the air-fuel control is predefined, the control described earlier is performed. Alternatively, in a case where the specified section i to be used as a reference for the air-fuel control is changed according to an operation status of the engine 1, the following control is performed. By changing the specified section i according to the operation status of the engine 1, the air-fuel control can be accurately performed. The following description is based on the assumption that the number of sections divided in the exhaust emission purification catalyst 19 (in other words, a unit length of the respective sections L) remains unchanged.

Figure 4:
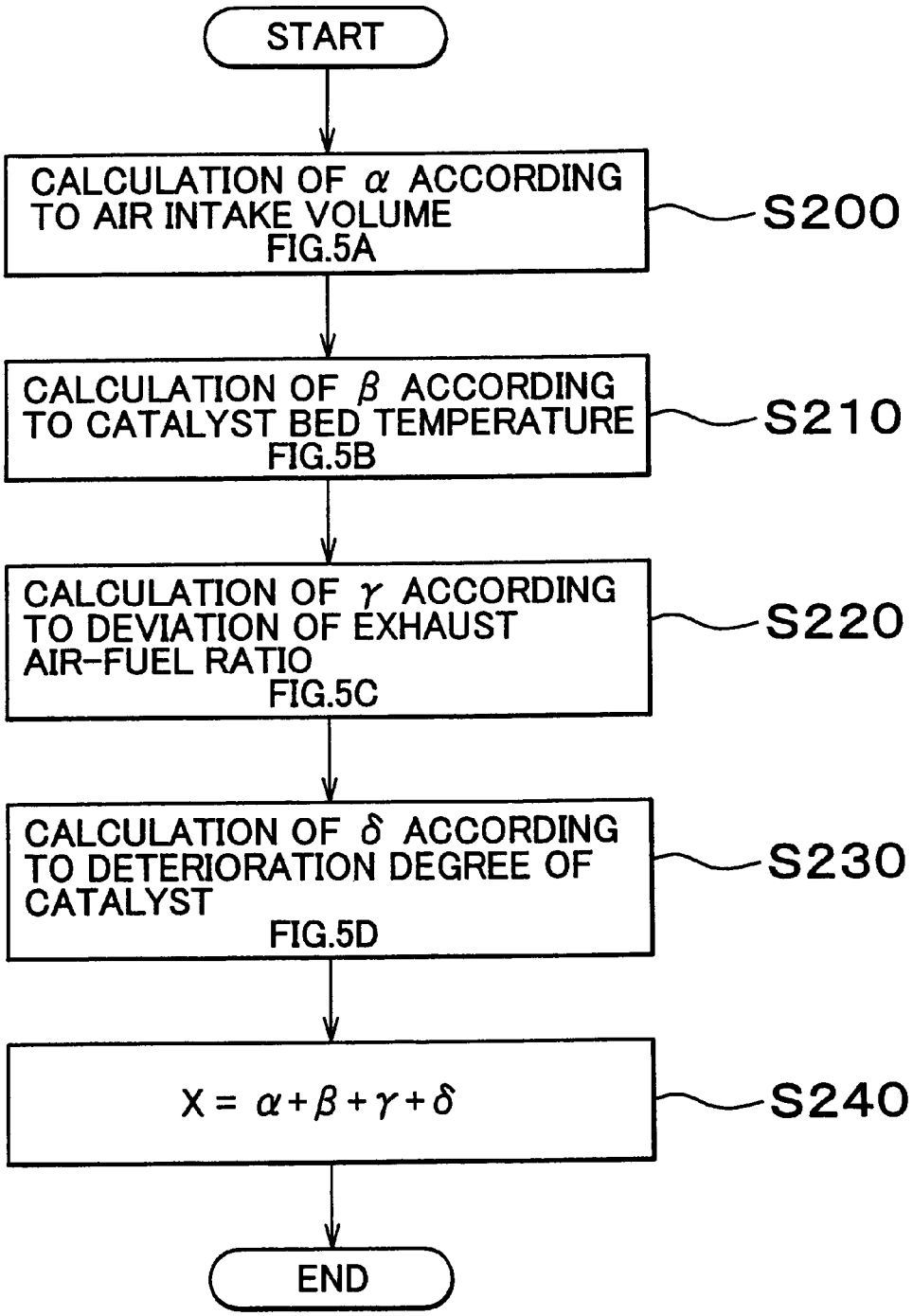
FIG. 4 is a flowchart of a control for determining a position of a specified section in the control system according to the embodiment of the invention.

In this control, a position of the specified section i to be used as a reference for the air-fuel control based on the oxygen storage amount $O_{2i}$ is determined on the basis of the air intake volume Ga, catalyst bed temperature Temp, exhaust air-fuel ratio A/F, and deterioration degree of the exhaust emission purification catalyst 19. To begin with, an X axis is provided in parallel with a flow direction of the exhaust gas at the exhaust emission purification catalyst 19. Also, an origin of this X axis (a reference position for determining the specified section i) is determined beforehand, and a forward direction of the X axis is defined as being the same as the flow direction of the exhaust gas extending from a downstream side to an upstream side thereof. For example, this reference position is set at the center of the exhaust emission purification catalyst 19 in the above-mentioned flow direction. FIG. 4 shows a flowchart for determination of the specified section i.

Figure 5A:
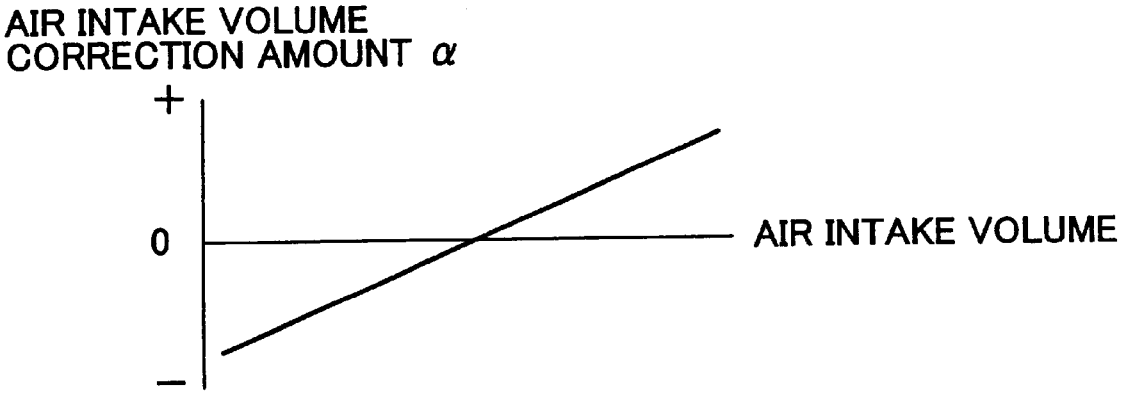
FIGS. 5A, FIG. 5B, FIG. 5C, and FIG. 5D are maps used for the control shown in FIG. 4.

First, in step S200, an air intake volume correction amount $\alpha$ is determined based on the air intake volume Ga detected by the air flow meter 13. FIG. 5A shows a map used for determining the air intake volume correction amount $\alpha$. As shown in FIG. 5A, a value of the air intake volume correction amount a is negative when the air intake volume Ga is small, and is positive when the air intake volume Ga is large, and increases as the air intake volume Ga increases.

Figure 5B:
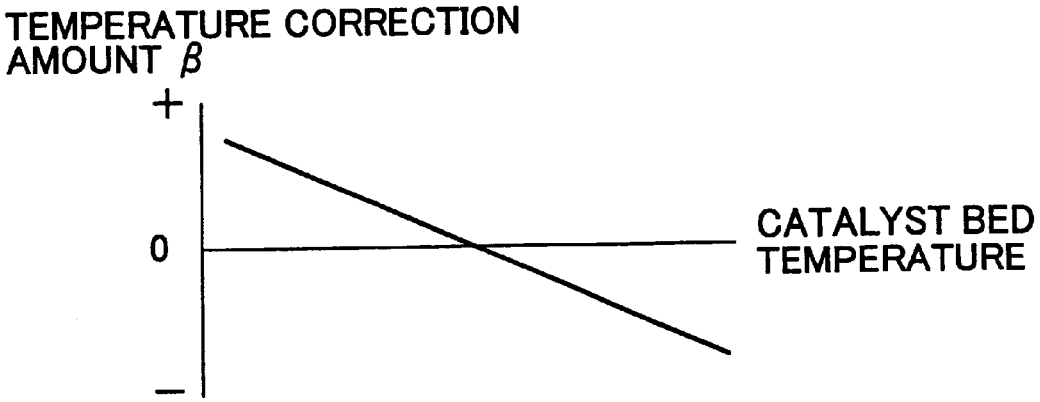

In step S210, a temperature correction amount $\beta$ is determined based on the catalyst bed temperature Temp (an overall catalyst bed temperature or a catalyst bed temperature at a specified section of the exhaust emission purification catalyst 19). FIG. 5B shows a map used for determining the temperature correction amount $\beta$. As shown in FIG. 5B, a value of the temperature correction amount $\beta$ is negative when the catalyst bed temperature Temp is high, and is positive when catalyst bed temperature Temp is low, and decreases as the catalyst bed temperature Temp decreases.

Figure 5C:
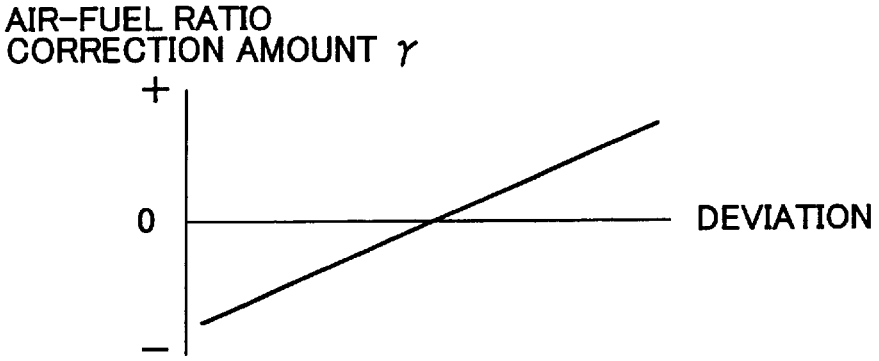

In step S220, an air-fuel ratio correction amount $\gamma$ is determined based on the exhaust air-fuel ratio A/F detected by the upstream air-fuel ratio sensor 25. FIG. 5C shows a map used for determining the air-fuel ratio correction amount $\gamma$. As shown in FIG. 5C, a value of the air-fuel ratio correction amount $\gamma$ is negative when an absolute value of deviation (deviation degree) $|\Delta A/F|$ of the detected exhaust air-fuel ratio A/F with respect to a stoichiometric air-fuel ratio is small, and is positive when the deviation degree $|\Delta A/F|$ is large, and increases as the deviation degree $|\Delta A/F|$ increases.

Figure 5D:
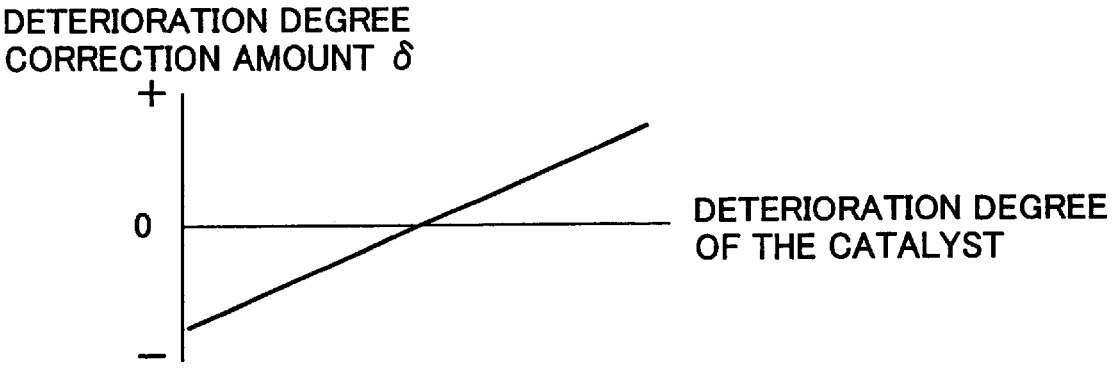

In step S230, a deterioration degree correction amount $\delta$ is determined based on the deterioration degree of the exhaust emission purification catalyst 19. The deterioration degree of the catalyst 19 is determined according to an output of the upstream air-fuel ratio sensor 25, oxygen storage amount $O_2$ ($O_{2i}$), oxygen adsorption/detachment amount $O_2AD$ ($O_2ADi$), an output of the downstream air-fuel ratio sensor 26 and the like. FIG. 5D shows a map used for determining the deterioration degree correction amount $\delta$. As shown in FIG. 5D, a value of the deterioration degree correction amount $\delta$ is negative when the deterioration degree of the exhaust emission purification catalyst 19 is small, and is positive when the deterioration degree is large, and increases as the deterioration degree increases.

In step S240, a X coordinate of the specified section i to be used as a reference for the air-fuel ratio control is determined by substituting the values of the obtained correction amounts α to δ in the following formula.

$$X=\alpha+\beta+\gamma+\delta$$

The specified section i for calculating the oxygen storage amount $O_{2i}$ to be used for the air-fuel ratio control is determined by the thus obtained X coordinate. For example, when the obtained X coordinate is equal to or larger than −0.5 but smaller than 0.5, a section at the X coordinate of 0 may be selected as the specified section i. Alternatively, when the obtained X coordinate is equal to or larger than 0.5 but smaller than 1.5, a section at the X coordinate of 1 (a section shifted toward the upstream side by one from the section at the X coordinate of 0) may be selected as the specified section i.

As each value of the correction amounts α to δ becomes larger, the specified section is set at a further upstream position. On the other hand, as each value of the correction amounts becomes smaller, the specified section is set at a further downstream position. Therefore, in a case where "blow-by phenomenon" occurs easily, the specified section i for calculating the oxygen storage amount $O_{2i}$ to used for the air-fuel ratio control is set in the upstream side. On the contrary, in a case where the "blow-by phenomenon" hardly occurs, the specified section i is set in the downstream side. The "blow-by phenomenon" is a phenomenon in which, even when the exhaust catalyst 19 still has a capacity to adsorb oxygen, oxygen flows toward the downstream side, or even when the exhaust catalyst 19 can detach oxygen to oxidize HC, CO and the like, such elements flow toward the downstream side without being oxidized.

In such a case when the blow-by phenomenon occurs easily, by controlling the air-fuel ratio based on an upstream portion of the exhaust emission purification catalyst 19, that is, setting the specified section i in the upstream side, an early feedback can be obtained, and an occurrence of the blow-by phenomenon can be prevented. Alternatively, in a case where the blow-by phenomenon hardly occurs, by controlling the air-fuel ratio based on a downstream portion of the exhaust emission purification catalyst 19, that is, setting the specified section i in the downstream side, a better control can be obtained.

When the air intake volume Ga is large, a larger volume of the exhaust gas flows into the exhaust emission purification catalyst 19 at a burst, and therefore the blow-by phenomenon occurs easily. When the catalyst bed temperature Temp is low, the blow-by phenomenon occurs easily since a sufficient reaction in the exhaust emission purification catalyst 19 is hindered. As the deviation degree |ΔA/F| of the exhaust gas flowing into the exhaust emission purification catalyst 19 with respect to the stoichiometric air fuel ratio is larger, more oxidization or reduction takes place. However,the blow-by phenomenon occurs more easily since elements easily flows toward the downstream before the oxidization or reduction is sufficiently completed. As the deterioration degree of the exhaust emission purification catalyst 19 is larger, that is, the catalyst has deteriorated more, the blow-by phenomenon occurs more easily since oxidization or deoxidization cannot be sufficiently completed.

In the above example, a unit length L of the respective sections of the exhaust emission purification catalyst 19 (see, e.g., FIG. 2) is unchanged. However, this unit length L may be changed according to the operation status of the engine 1. By changing the unit length L according to the operation status of the engine 1 as mentioned, the oxygen adsorption status of the exhaust emission purification catalyst 19 can be detected more accurately, and the air-fuel ratio control based on the oxygen storage amount $O_{2i}$ can be accurately conducted. In such a case, the unit length L is first determined by a control described below, and the specified section i is determined by the aforementioned control to control the air-fuel ratio on the basis of the oxygen storage amount in the specified section i $O_{2i}$.

Figure 6:
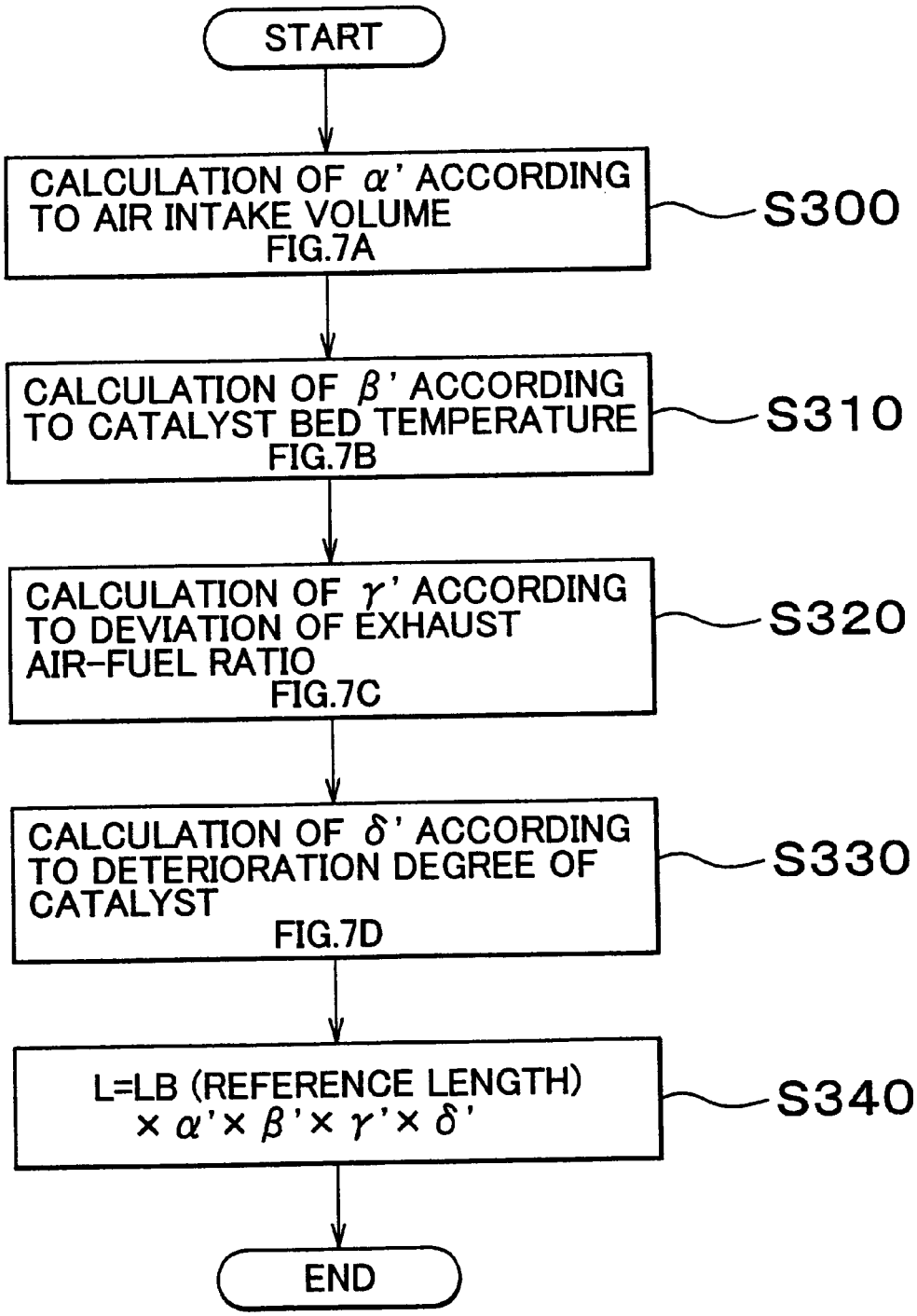
FIG. 6 is a flowchart of a control for determining a unit length of a specified section in the control system according to the embodiment of the invention.

In this control, as well as the aforementioned control for determining the position of the specified section i, the unit length L, which is the unit length of the respective sections of the exhaust emission purification catalyst 19, is determined according to the air intake volume Ga, catalyst bed temperature Temp, exhaust air-fuel ratio A/F, and deterioration degree of the exhaust emission purification catalyst 19. FIG. 6 shows a flowchart of determination of the unit length L.

Figure 7A:
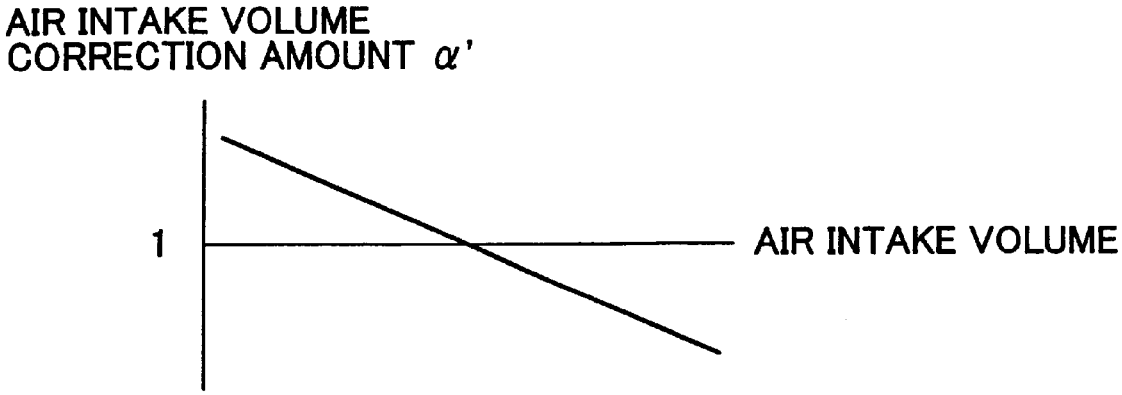
FIGS. 7A, FIG. 7B, FIG. 7C and FIG. 7D are maps for the control shown in FIG. 6.

First, in step S300, an air intake volume correction amount α' is determined based on the air intake volume Ga detected by the air flow meter 13. FIG. 7A shows a map used for determining the air intake volume correction amount α'. As shown in FIG. 7A, a value of the air intake volume correction amount α' is larger than 1 when the air intake volume Ga is small, and is smaller than 1 but larger than 0 when the air intake volume Ga is large, and decreases as the air intake volume Ga increases.

Figure 7B:
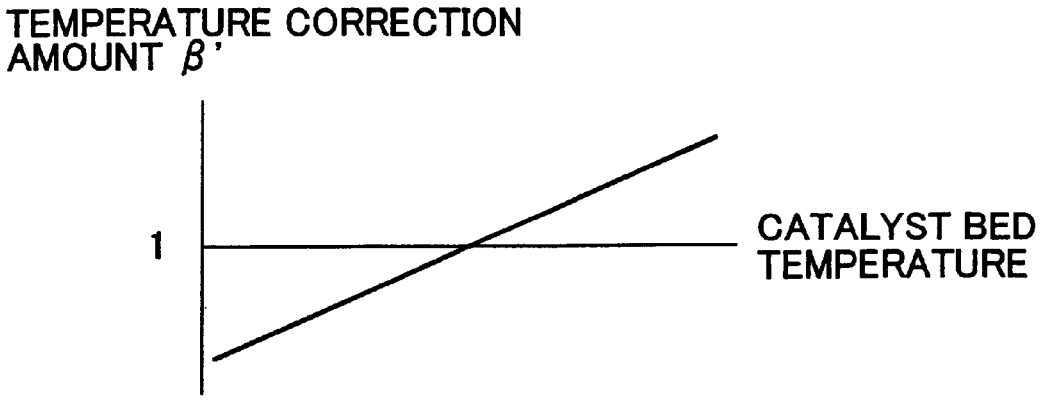

In step S310, a temperature correction amount β' is determined based on the catalyst bed temperature Temp (an overall catalyst bed temperature or a catalyst bed temperature at a specified section of the exhaust emission purification catalyst 19). FIG. 7B shows a map used for determining the temperature correction amount β'. As shown in FIG. 7B, a value of the temperature correction amount β' is larger than 1 when the catalyst bed temperature Temp is high, and is smaller than 1 but larger than 0 when the catalyst bed temperature Temp is low, and increases as the catalyst bed temperature Temp increases.

Figure 7C:
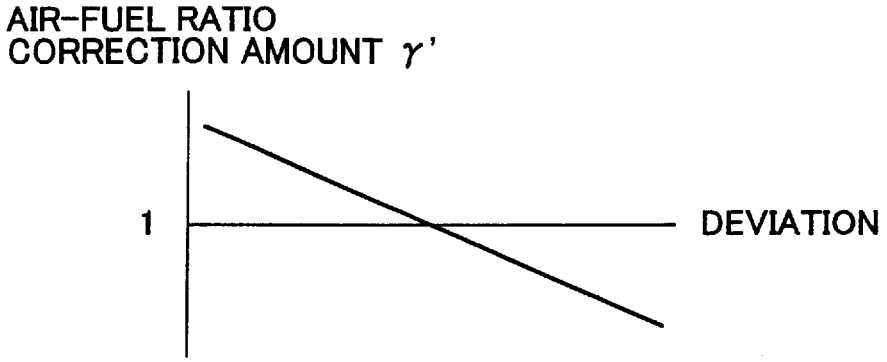

In step S320, an air-fuel ratio correction amount γ' is determined based on the exhaust air-fuel ratio A/F detected by the upstream air-fuel ratio sensor 25. FIG. C shows a map used for determining the air-fuel ratio correction amount γ'. As shown in FIG. 7C, a value of the air-fuel ratio correction amount γ' is larger than 1 when an absolute value of deviation (deviation degree) |ΔA/F| of the detected exhaust air-fuel ratio A/F with respect to the stoichiometric air-fuel ratio is small, and is smaller than 1 but larger than 0 when the deviation degree |ΔA/F| is large, and decreases as the deviation degree |ΔA/F| increases.

Figure 7D:
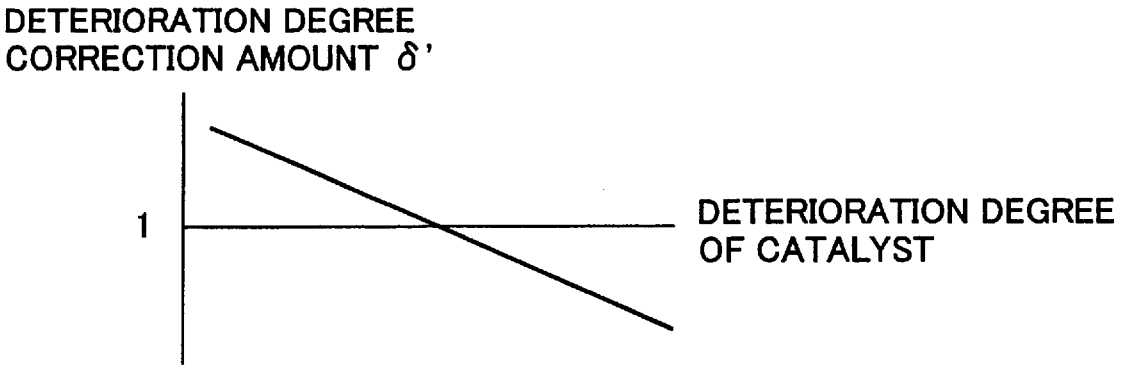

Further, in step S330, a deterioration degree correction amount δ' is determined based on the deterioration degree of the exhaust emission purification catalyst 19. The deterioration degree of the catalyst 19 is determined according to the output of the upstream air-fuel ratio sensor 25, oxygen storage amount $O_2$ ($O_{2i}$), oxygen adsorption/detachment amount $O_2AD$ ($O_2ADi$), output of the downstream air-fuel ratio sensor 26 and the like. FIG. 7D shows a map used for determining the deterioration degree correction amount δ'. As shown in FIG. 7D, a value of the deterioration degree correction amount δ' is larger than 1 when the deterioration degree of the exhaust emission purification catalyst 19 is small, and is smaller than 1 but larger than 0 when the deterioration degree is large, and decreases as the deterioration degree increases.

In step S340, the unit length L of the respective sections of the exhaust emission purification catalyst 19 can be determined by substituting the values of the thus obtained correction amounts α' to δ' in the following formula.

$$L=LB\times\alpha'\times\beta'\times\gamma'\times\delta'$$

LB is a reference length. Hence, when all the values of the correction amounts α' to δ' are 1, the unit length L is equal to LB.

The above-mentioned correction amounts α' to δ' are so set as to improve controllability and control accuracy of the air-fuel ratio control. Hunting may occur when the oxygen storage amount $O_{2i}$ in the specified section i is too large. In such a case, the correction amounts α' to δ' are changed such that the unit length L becomes small and a change in the oxygen storage amount $O_{2i}$ per specified section i is reduced, whereby the change in the oxygen storage amount $O_{2i}$ in the specified section i is prevented from becoming too large. On the other hand, a response of the air-fuel ratio control may deteriorate when the change in the oxygen storage amount in the specified section i is too small. In such a case, the correction amounts α' to δ' are changed such that the unit length L becomes large, whereby the change in the oxygen storage amount $O_{2i}$ in the specified section i is prevented from becoming too small.

When the air intake volume Ga is large, the change in the oxygen storage amount $O_{2i}$ in the specified section i tends to become large easily, and when the air intake volume Ga is small, it tends to become small easily. When the catalyst bed temperature Temp is low, the change in the oxygen storage amount $O_{2i}$ in the specified section i tends to become large easily since a sufficient reaction in the exhaust emission purification catalyst 19 is hindered. As the deviation degree $|\Delta A/F|$ of the exhaust gas flowing into the exhaust emission purification catalyst 19 with respect to the stoichiometric air fuel ratio is larger, more oxidization or reduction takes place, and therefore the change in the oxygen storage amount $O_{2i}$ in the specified section i tends to become large easily. As the deterioration degree of the exhaust emission purification catalyst 19 is larger, that is, the catalyst has deteriorated more, the change in the oxygen storage amount $O_{2i}$ in the specified section i tends to become large more easily.

In the above-mentioned example, only one specified section is provided. However, a plurality of the specified sections to be used as a reference for the air-fuel control based on the oxygen storage amount may be provided. By providing a plurality of the specified sections, the oxygen adsorption status in the exhaust emission purification catalyst 19 can be detected more accurately, and thereby the air-fuel ratio control based on the oxygen storage amount can be performed more accurately. Further, by providing a plurality of the specified sections, a distribution of the oxygen adsorption status in the exhaust emission purification catalyst 19 can be optimized, and thereby the air-fuel ratio control which enables a further improvement in the exhaust purification efficiency can be conducted.

Figure 8:
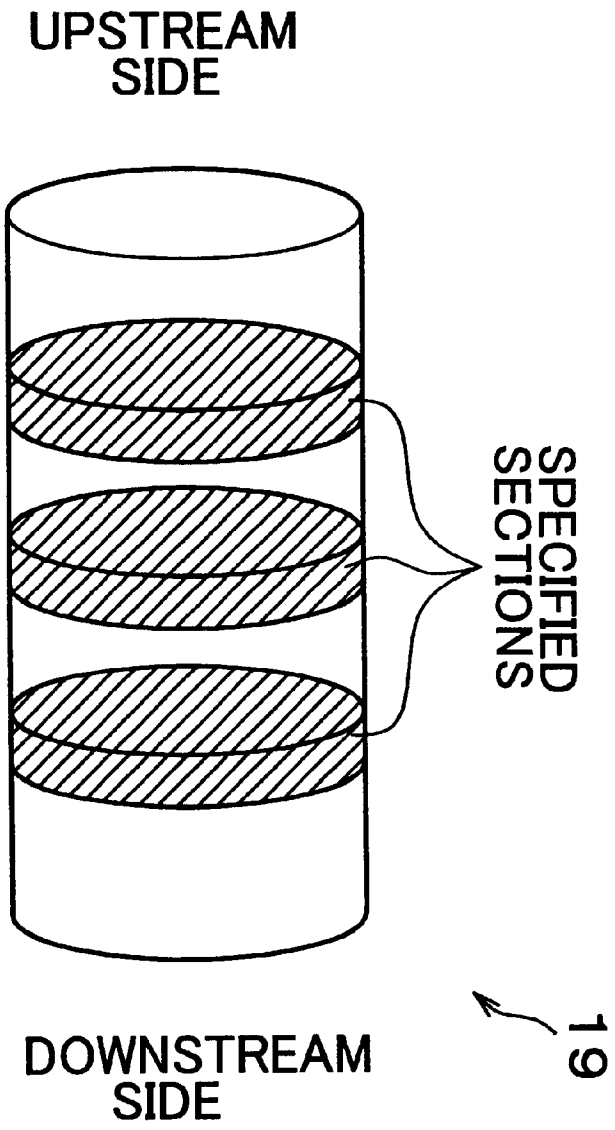
FIG. 8 is perspective view schematically illustrating the exhaust emission purification catalyst of the control system according to a second embodiment of the invention.
Figure 9:
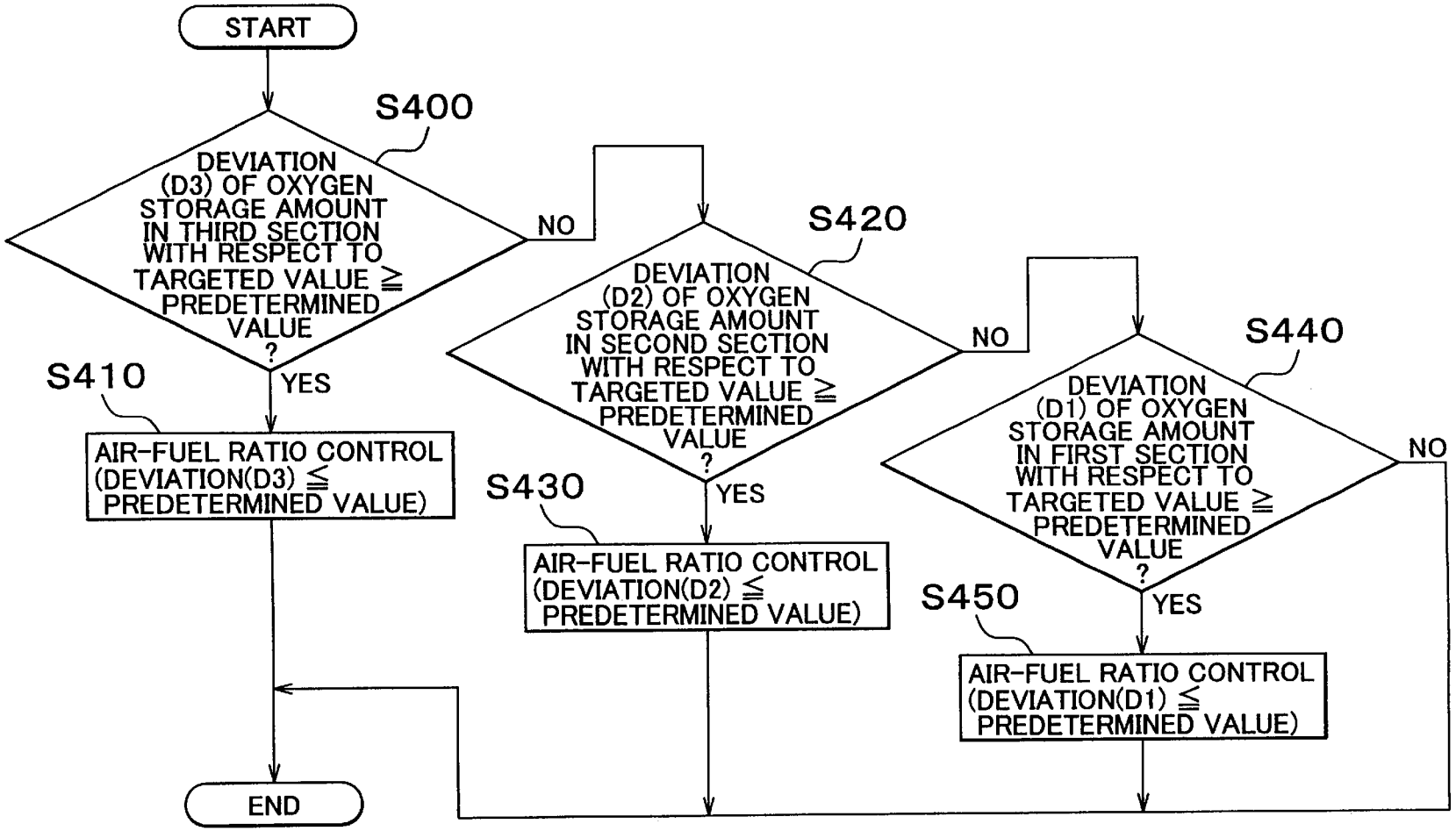
FIG. 9 is a flowchart of the air-fuel ratio control in the control system according to a second embodiment of the invention.

FIG. 8 illustrates a second example in which three specified sections are provided. The determination of the unit length of the specified section, determination (selection) of the position of the specified section, and the like in this example are the same as in the aforementioned control based on one specified section and therefore will not be described in detail. FIG. 9 shows a flowchart of an example of this control. As schematically illustrated in FIG. 10, this control converges the oxygen storage amounts in the three specified sections to a targeted value sequentially from the downstream side to the upstream side.

Figure 10A:
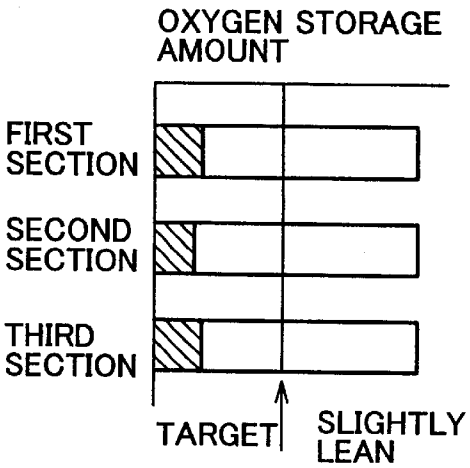
FIGS. 10A, FIG. 10B, FIG. 10C, and FIG. 10D are graphs which show changes in an oxygen storage amount in the respective specified sections of the exhaust emission purification catalyst achieved by the air-fuel ratio control in the control system according to the second embodiment of the invention.
Figure 10B:
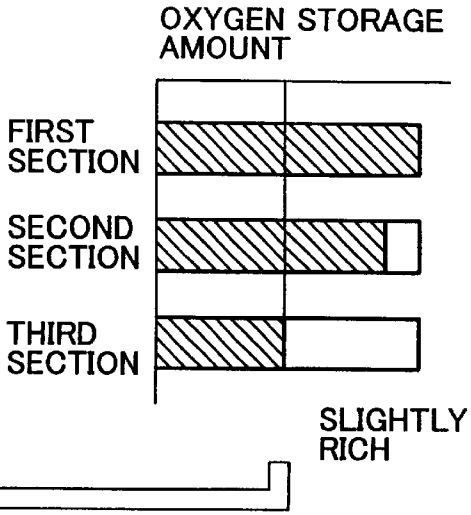
Figure 10C:
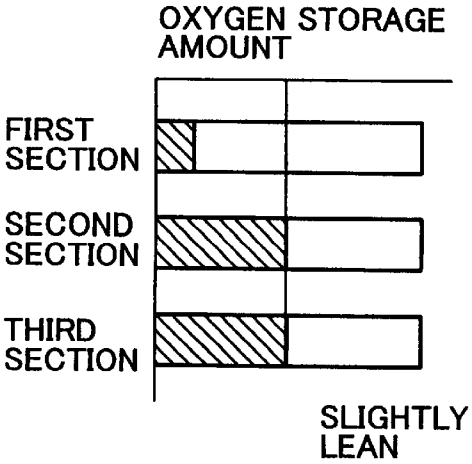
Figure 10D:
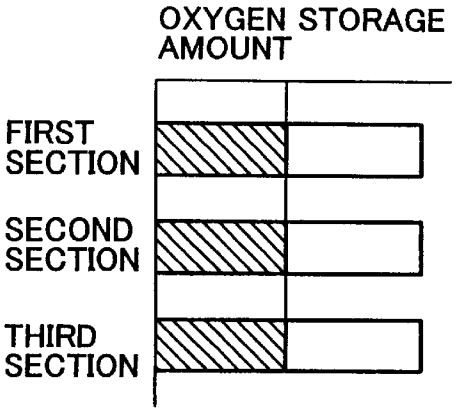

By way of illustration, an example will hereafter be described. In a case where the respective oxygen storage amounts in three specified sections (upstream specified section, center specified section, downstream specified section) are as shown in FIG. 10A, the air-fuel ratio is controlled to be slightly lean, whereby the oxygen storage amount in the downstream specified section satisfies a targeted value. In this state, oxygen adsorption tends to take place more easily in the upstream side and accordingly the oxygen storage amount in the upstream side becomes relatively large. Therefore, the air-fuel ratio is controlled to be slightly rich in turn. As a result, oxygen detachment also tends to take place more easily in the upstream side and accordingly the oxygen storage amount in the upstream side decreases. Thus, the oxygen storage amount in the center specified section is controlled to satisfy the targeted value as shown in FIG. 10C. At this time, since the oxygen storage amount in the upstream side decreases, the air-fuel ratio is controlled to be slightly lean, whereby the oxygen storage amount in the upstream specified section satisfies the targeted value.

Thus, the targeted value can be satisfied in all the three specified sections of the exhaust emission purification catalyst. Additionally, in this example, the three specified sections are provided as the upstream, center, and downstream specified sections. Therefore, it is possible to obtain an ideal state where the distribution of the oxygen storage amounts in the exhaust emission purification catalyst 19 is substantially uniform by satisfying the targeted value in all of the three specified sections.

Figure 11A:
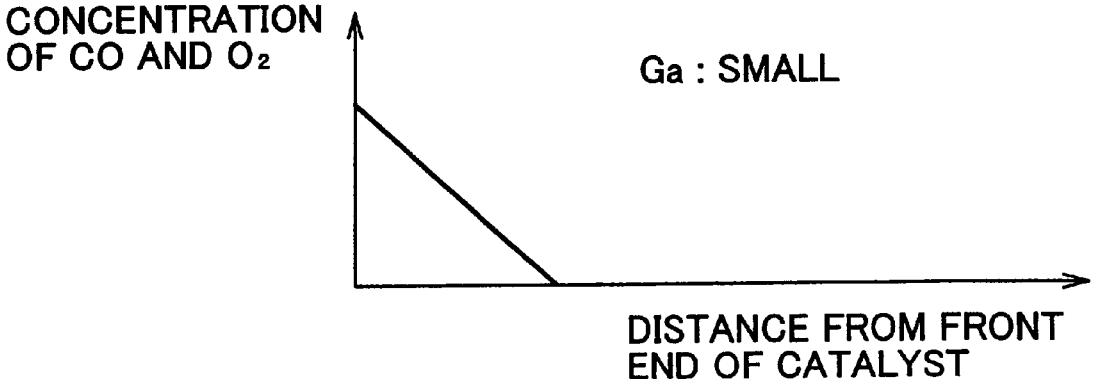
FIG. 11 is a graph which shows a relationship between an air intake volume and concentrations of carbon monoxide and oxygen in the exhaust emission purification catalyst.
Figure 11B:
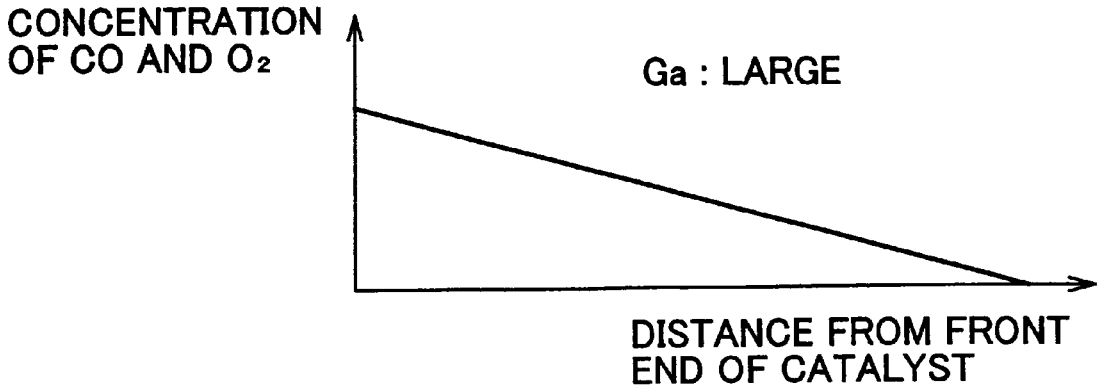

As shown in FIG. 11A and FIG. 11B, this control utilizes a change in a distribution of the exhaust gas within the exhaust emission purification catalyst 19 according to the air intake volume Ga, and the like. When the air intake volume Ga is small and therefore a flow rate of the exhaust gas flowing into the exhaust emission purification catalyst 19 is low as shown in FIG. 11A, oxygen adsorption/detachment takes place mainly in the upstream side of the exhaust emission purification catalyst 19. Alternatively, when the air intake volume Ga is large and therefore the flow rate of the exhaust gas is high as shown in FIG. 11B, the oxygen adsorption/detachment take place also in the downstream side of the exhaust emission purification catalyst 19.

According to FIG. 9, the upstream specified section, the center specified section, and the downstream specified section will be referred to as, "a first section", "a second section", and "a third section" for convenience. In FIG. 9, in order to converge the oxygen storage amount to a targeted value from the third specified section, first, it is determined whether or not a deviation of the oxygen storage amount in the third section with respect to the targeted value is larger than a predetermined value in step S400. When it is determined that the deviation of the oxygen storage amount in the third specified section with respect to the targeted value is larger than the predetermined value and accordingly the oxygen storage amount in the third specified section has not converged to the targeted value, the air-fuel ratio control is performed such that the deviation becomes equal to or smaller than the predetermined value in step S410.

Alternatively, when it is determined that the deviation of the oxygen storage amount in the third specified section with respect to the targeted value is equal to or smaller than the predetermined value and accordingly the oxygen storage amount in the third specified section has already been converged to the targeted value, it is determined whether or not the oxygen storage amount in the second specified section with respect to the targeted value is larger than the predetermined value in step S420. When it is determined that the deviation of the oxygen storage amount in the second specified section with respect to the targeted value is larger than the predetermined value and accordingly the oxygen storage amount in the second specified section has not converged to the targeted value, the air-fuel ratio control is performed such that the deviation becomes equal to or smaller than the predetermined value in step S430.

Similarly, when it is determined that the deviation of the oxygen storage amount in the second specified section with respect to the targeted value is equal to or smaller than the predetermined value and accordingly the oxygen storage amount in the second specified section has already converged to the targeted value, it is determined whether or not the oxygen storage amount in the first specified section with respect to the targeted value is larger than the predetermined value in step S440. When it is determined that the deviation of the oxygen storage amount in the first specified section with respect to the targeted value is larger than the predetermined value and accordingly the oxygen storage amount in the first specified section has not converged to the targeted value, the air-fuel ratio control is performed such that the deviation becomes equal to or smaller than the predetermined value in step S450.

When the deviation of the oxygen storage amount in the first specified section with respect to the targeted value is determined to be equal to or smaller than the predetermined value, it is determined that the targeted value for the oxygen storage amounts have converged to the target value in all of the first, second, and third specified sections and a control in the flowchart in FIG. 9 is terminated. By repeating the control in the flowchart in FIG. 9, the oxygen storage amounts in all of the first, second, and third sections eventually converged to the targeted value, and the deviation is determined to be equal to or smaller than the predetermined value in the step S440.

Figure 12:
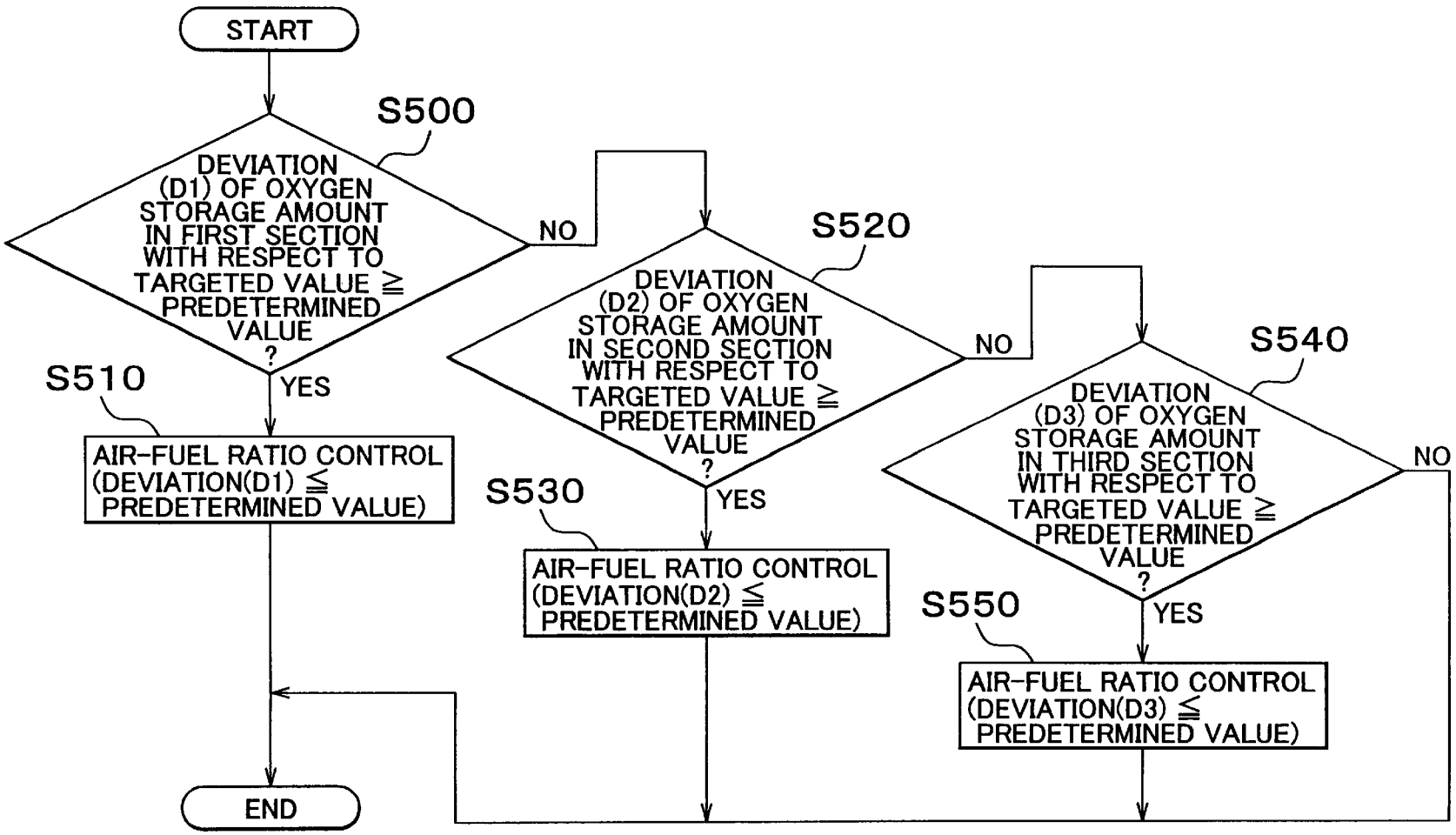
FIG. 12 is a flowchart of the air-fuel ratio control by the control system according to a third embodiment of the invention.

In the above-mentioned control in the flow chart in FIG. 9, the oxygen storage amounts are converged to the targeted value from a specified section in the downstream side. In a control that will hereafter be described, the oxygen storage amounts are converged to the targeted value from a specified section in the upstream side. FIG. 12 is a flowchart for this control, and FIG. 13 corresponds to FIG. 10.

Figure 13A:
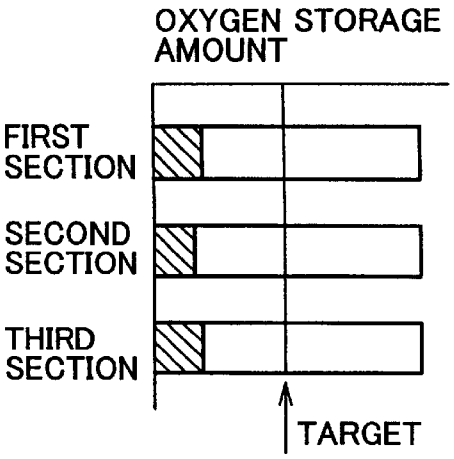
FIGS. 13A, FIG. 13B, FIG. 13C, and FIG. 13D are graphs which show changes in the oxygen storage amount in the respective specified sections of the exhaust emission purification catalyst achieved by the air-fuel ratio control in the control system according to the third embodiment of the invention.
Figure 13B:
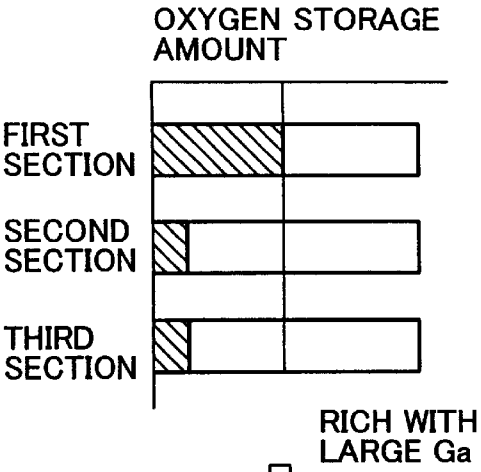

By way of illustration, an example will hereafter be described. In a case where the respective oxygen storage amounts in three specified sections (upstream specified section, center specified section, downstream specified section) are as shown in FIG. 13A, the air-fuel ratio is controlled to be slightly lean, and the oxygen storage amount in the upstream specified section satisfies a targeted value as shown in FIG. 13B. In this state, oxygen adsorption tends to take place more easily in the upstream side and accordingly, the oxygen storage amount in the upstream side becomes relatively large. Therefore, the air-fuel ratio is controlled to be slightly lean in a condition where the air intake volume Ga is large. As a result, oxygen adsorption takes place also in the downstream side due to a large air intake volume Ga, which increases the oxygen storage amount in the downstream side. At this time, in the upstream side, a phenomenon similar to the blow-by phenomenon occurs. That is, oxygen flows toward the downstream side without being adsorbed. Therefore, the oxygen storage amount remains almost unchanged.

Figure 13C:
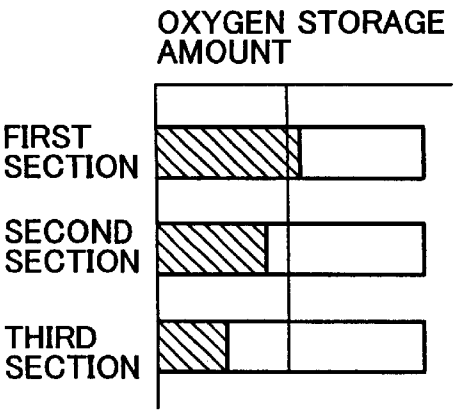
Figure 13D:
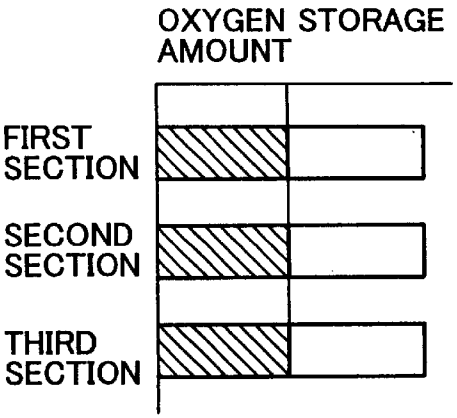

In such a manner, the targeted value can be satisfied in all of the three specified sections of the exhaust emission purification catalyst as shown in FIG. 13C and FIG. 13D. Additionally, in this example, the three specified sections are provided as the upstream, center, and downstream specified sections. Therefore, it is possible to obtain an ideal state where the distribution of the oxygen storage amounts in the exhaust emission purification catalyst 19 are substantially uniform by satisfying the targeted value in all of the three specified sections.

In FIG. 12, the upstream specified section, the center specified section, and the downstream specified section will be referred to as "first section", "second section", and "third section," for convenience. In this example, in order to converge the oxygen storage amount to a targeted value from the first specified section, first it is determined whether or not a deviation of the oxygen storage amount in the first section with respect to the targeted value is larger than a predetermined value in step S500. When it is determined that the deviation of the oxygen storage amount in the first specified section with respect to the targeted value is larger than the predetermined value and that the oxygen storage amount in the third specified section has not been converged to the targeted value, the air-fuel ratio control is performed such that the deviation becomes equal to or smaller than the predetermined value in steps S510.

Alternatively, when it is determined that the deviation of the oxygen storage amount in the first specified section with respect to the targeted value is equal to or smaller than the predetermined value and accordingly the oxygen storage amount in the first specified section has already converged to the targeted value, it is determined whether or not the oxygen storage amount in the second specified section with respect to the targeted value is larger than the predetermined value in step S520. When it is determined that the deviation of the oxygen storage amount in the second specified section with respect to the targeted value is larger than the predetermined value and that the oxygen storage amount in the second specified section has not converged to the targeted value, the air-fuel ratio control is performed such that the deviation becomes equal to or smaller than the predetermined value in step S530.

Similarly, when it is determined that the deviation of the oxygen storage amount in the second specified section with respect to the targeted value is equal to or smaller than the predetermined value and that the oxygen storage amount in the second specified section has already converged to the targeted value, it is determined whether or not the oxygen storage amount in the third specified section with respect to the targeted value is larger than the predetermined value in step S540. Then, when it is determined that the deviation of the oxygen storage amount in the third specified section with respect to the targeted value is larger than the predetermined value and that the oxygen storage amount in the third specified section has not been converged to the targeted value, the air-fuel ratio control is performed such that the deviation becomes equal to or smaller than the predetermined value in step S550.

In a case that the deviation of the oxygen storage amount in the third specified section with respect to the targeted value is determined to be larger than the predetermined value, it is determined that the targeted value for the oxygen storage amounts has been satisfied in all of the first, second, and third specified sections and a control in the flowchart in FIG. 12 is terminated. By repeating the control in the flowchart in FIG. 9, the oxygen storage amounts in all of the first, second, and third sections eventually converge to the targeted value, and the deviation is determined to be equal to or smaller than the predetermined value in the steps S540.

It is to be noted that the invention should not be limited to the aforementioned exemplary embodiments. For example, the targeted value of the oxygen storage amount $O_2$ ($O_{2i}$) may be provided as either a fixed or variable value.

According to the aforementioned embodiments of the invention, an exhaust emission purification catalyst can be regarded as being divided into multiple sections, and an oxygen storage amount can be estimated for a specified section among the multiple sections and an air-fuel ratio control can be performed based on the oxygen storage amount in the specified section. Therefore, the oxygen adsorption capacity of the exhaust emission purification catalyst can be effectively used and the condition of the exhaust emission purification catalyst is reflected on the air-fuel ratio control more accurately, which improves the purification efficiency of the exhaust gas. In addition, the condition of the exhaust catalyst can be reflected on the air-fuel ratio control even more accurately by changing the unit length or position of the specified sections according to an operation status of an internal combustion engine.

In the illustrated embodiment, the controller (the ECU 18) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. An air-fuel ratio control system for an internal combustion engines comprising:

a controller that:

divides a catalyst provided in an exhaust passage of an internal combustion engine into multiple sections in a flow direction of an exhaust gas, calculates a change in an oxygen storage amount in a specified section among the multiple sections based on an air-fuel ratio of an exhaust gas flowing into the catalyst, estimates the oxygen storage amount in the specified section among the multiple sections based on a record of the change in the oxygen storage amount; and controls the air-fuel ratio based on the estimated oxygen storage amount.

2. An air-fuel ratio control system according to claim 1, wherein:

the controller calculates an upstream side oxygen storage amount in an upstream section located upstream of the specified section based on the air fuel ratio of the exhaust gas flowing into the catalyst, calculates an oxygen amount flowing into respective sections located downstream of the upstream section sequentially based on the upstream side oxygen storage amount, estimates the oxygen storage amount in the specified section based on the oxygen amount flowing into respective sections located between the upstream section and the specified section.

3. The air-fuel ratio control system according to claim 1, wherein:

the controller changes a position of the specified section in accordance with an operation status of the internal combustion engine.

4. The air-fuel ratio control system according to claim 3, wherein:

the controller changes the position of the specified section to a farther upstream position as an air intake volume increases.

5. The air-fuel ratio control system according to claim 3, wherein:

the controller changes the position of the specified section to a farther upstream position as a bed temperature of the catalyst decreases.

6. The air-fuel ratio control system according to claim 3, wherein:

the controller changes the position of the specified section to a farther upstream position as a deviation of an exhaust air-fuel ratio of an exhaust gas flowing into the catalyst with respect to a stoichiometric air fuel ratio increases.

7. The air-fuel ratio control system according to claim 3, wherein:

the controller changes the position of the specified section to a farther upstream position as a deterioration degree of the catalyst increases.

8. The air-fuel ratio control system according to claim 1, wherein:

the controller changes a unit length of the respective specified sections in accordance with an operation status of the internal combustion engine.

9. The air-fuel ratio control system according to claim 8, wherein:

the controller decreases the unit length of the respective specified sections as an air intake volume is increased.

10. The air-fuel ratio control system according to claim 8, wherein:

the controller decreases the unit length of the respective specified sections as a bed temperature of the catalyst is decreased.

11. The air-fuel ratio control system according to claim 8, wherein:

the controller decreases the unit length of the respective specified sections as a deviation of an exhaust air-fuel ratio of an exhaust gas flowing into the catalyst with respect to a stoichiometric air fuel ratio is increased.

12. The air-fuel ratio control system according to claim 8, wherein:

the controller decreases the unit length of the respective specified sections as a deterioration degree of the catalyst is increased.

13. The air-fuel ratio control system according to claim 1, wherein:

a plurality of the specified sections are designated, and the controller controls the air-fuel ratio such that the oxygen storage amounts in the plurality of the specified sections satisfy respective targeted values.

14. The air-fuel ratio control system according to claim 13, wherein:

the controller controls the air-fuel ratio such that the oxygen storage amounts in the plurality of the specified sections satisfy a targeted value sequentially from a downstream side to an upstream side.

15. The air-fuel ratio control system according to claim 13, wherein:

the controller controls the air-fuel ratio such that the oxygen storage amounts in the plurality of the specified sections satisfy a targeted value sequentially from an upstream side to a downstream side.

16. The air-fuel ratio control system for an internal combustion engines comprising:

a controller that:

divides a catalyst provided in an exhaust passage of an internal combustion engine into multiple sections in a flow direction of an exhaust gas, calculates a change in an oxygen storage amount in a specified section among the multiple sections based on an air-fuel ratio of an exhaust gas flowing into the catalyst, estimates the oxygen storage amount in the specified section based on a record of the change in the oxygen storage amount; and controls the air-fuel ratio based on the oxygen storage amount in the specified section.

17. The air-fuel ratio control system according to claim 16, wherein:

the controller calculates the change in the oxygen storage amount in an upstream side of an upstream section located upstream of the specified section based on the air fuel ratio of the exhaust gas flowing into the catalyst, and estimates the oxygen storage amount in the specified section based on an oxygen amount flowing into the respective sections located downstream of the upstream section, the oxygen amount being calculated based on the change in oxygen storage amount in the upstream side.

18. The air-fuel ratio control system according to claim 16, wherein:

the controller changes a position of the specified section in accordance with an operation status of the internal combustion engine.

19. The air-fuel ratio control system according to claim 16, wherein:

the controller changes a unit length of the respective sections in accordance with the operation status of the internal combustion engine.

20. The air-fuel ratio control system according to claim 16, wherein:

a plurality of the specified sections are designated, and the controller controls the air-fuel ratio such that the oxygen storage amounts in the plurality of the specified sections satisfy respective targeted values.

21. An air-fuel ratio control method for an internal combustion engine comprising the steps of:

dividing a catalyst provided in an exhaust passage of the internal combustion engine into multiple sections in a flow direction of the exhaust gas, calculating a change in an oxygen storage amount in a specified section among the multiple sections based on an air-fuel ratio of an exhaust gas flowing into the catalyst, estimating the oxygen storage amount in the specified section based on a record of the change in the oxygen storage amount, and controlling the air-fuel ratio based on the estimated oxygen storage amount.

22. The air-fuel ratio control method according to claim 21, wherein the oxygen storage amount in an upstream section located upstream of the specified section is calculated based on the air fuel ratio of the exhaust gas flowing into the catalyst in the calculating step, and the oxygen storage amount in the specified section is estimated based on an oxygen amount flowing into the respective sections located downstream of the upstream section, the oxygen amount being calculated based on the oxygen storage amount in the estimating step.

23. The air-fuel ratio control method according to claim 21, wherein:

the position of the specified section is changed in accordance with an operation status of the internal combustion engine in the calculating step.

24. The air-fuel ratio control method according to claim 21, wherein:

the unit length of the respective sections is changed in accordance with an operation status of the internal combustion engine in the calculating step.

25. The air fuel ratio control method according to claim 21, wherein:

a plurality of the specified sections are designated, and the air-fuel ratio is controlled such that the oxygen storage amounts in the respective specified sections satisfy respective targeted values.

* * * * *